US007383771B2

(12) United States Patent
Baintner et al.

(10) Patent No.: US 7,383,771 B2
(45) Date of Patent: Jun. 10, 2008

(54) WEB-FED ROTARY PRINTING UNIT

(75) Inventors: Alfons Baintner, Aystetten (DE); Max Eder, Mering (DE)

(73) Assignee: MAN Roland Druckmaschinen AG, Offenbach (DE)

( * ) Notice: Subject to any disclaimer, the term of this patent is extended or adjusted under 35 U.S.C. 154(b) by 212 days.

(21) Appl. No.: 11/003,859

(22) Filed: Dec. 3, 2004

(65) Prior Publication Data

US 2005/0166773 A1 Aug. 4, 2005

(30) Foreign Application Priority Data

Dec. 5, 2003 (DE) ..... 103 57 005
Jan. 22, 2004 (DE) ..... 10 2004 003 339

(51) Int. Cl.
*B41F 5/04* (2006.01)

(52) U.S. Cl. ..... 101/219; 101/216

(58) Field of Classification Search ..... 101/216–219, 101/177, 183, 248
See application file for complete search history.

(56) References Cited

U.S. PATENT DOCUMENTS

| | | | | |
|---|---|---|---|---|
| 4,394,835 | A * | 7/1983 | Gertsch et al. | 101/177 |
| 4,696,229 | A * | 9/1987 | Bezler et al. | 101/177 |
| 6,032,579 | A * | 3/2000 | Richards | 101/219 |
| 6,332,397 | B1 * | 12/2001 | Bolza-Schunemann et al. | 101/183 |
| 6,334,389 | B1 * | 1/2002 | Fischer | 101/216 |
| 6,647,874 | B1 * | 11/2003 | Siegl et al. | 101/211 |
| 6,651,557 | B1 * | 11/2003 | Costin et al. | 101/218 |
| 6,766,737 | B2 * | 7/2004 | Glockner et al. | 101/228 |
| 6,817,292 | B2 * | 11/2004 | Gerner et al. | 101/217 |
| 6,827,011 | B2 * | 12/2004 | Liebler et al. | 101/177 |
| 7,156,018 | B2 * | 1/2007 | Holm et al. | 101/218 |
| 2001/0017087 | A1 * | 8/2001 | Schneider et al. | 101/216 |
| 2001/0037737 | A1 * | 11/2001 | Koppelkamm et al. | 101/147 |
| 2002/0096066 | A1 * | 7/2002 | Callahan et al. | 101/183 |

FOREIGN PATENT DOCUMENTS

| | | |
|---|---|---|
| DE | 432854 C | 8/1926 |
| DE | 2637795 A1 | 2/1978 |
| DE | 9117008.7 U1 | 8/1993 |
| DE | 19951157 A1 | 5/2001 |
| DE | 10046376 A1 | 4/2002 |
| EP | 0459098 A1 | 12/1991 |

* cited by examiner

*Primary Examiner*—Anthony H. Nguyen
(74) *Attorney, Agent, or Firm*—Leydig, Voit & Mayer, Ltd

(57) ABSTRACT

A web-fed rotary printing unit having a plurality of printing mechanisms is provided. Each printing mechanism includes a form cylinder (1, 5, 16-18, 27-30), a transfer cylinder (2, 6, 3, 7, 12-15, 22-25) and a separate or common impression cylinder (3, 7, 11, 26). Stress torques acting on the drive motors can be eliminated to the greatest possible extent by providing a drive motor that has a drive connection to the further cylinders via the impression cylinder.

16 Claims, 14 Drawing Sheets

WEB-FED ROTARY PRINTING UNIT

FIELD OF THE INVENTION

The invention relates generally to web-fed rotary printing units having a plurality of printing mechanisms, each printing mechanism including a form cylinder, a transfer cylinder and a dedicated or common impression cylinder. The invention has particular application in newspaper presses.

BACKGROUND OF THE INVENTION

In known printing units, each printing mechanism, which typically comprises a transfer cylinder, a form cylinder and an inking and damping unit, is driven by a dedicated drive motor. An impression cylinder, which can be assigned to one or more transfer cylinders, is either driven by a dedicated drive motor or is concurrently mechanically driven by a printing mechanism. Accordingly, in a printing mechanism comprising, for example, four printing mechanisms, a plurality of drive motors are used. In addition, a mechanical drive connection is not provided between the printing mechanisms in order to synchronize the printing mechanisms. If a dedicated drive motor also drives an impression cylinder, there is also no mechanical drive connection between the impression cylinder and the associated transfer cylinders. The synchronization of the printing mechanisms and the impression cylinders, each of which is driven by its own dedicated motor, is performed by the respective drive motors. As a result, the stress torques acting within the printing unit place a very high additional load on the drive motors or the loads must be relieved. For this reason, the drive motors must have a very high motor output or torque.

BRIEF SUMMARY OF THE INVENTION

In view of the foregoing, an object of the invention is providing drive concepts in which the stress torques act as little as possible or even not at all on the drive motors. According to one aspect of the invention, this is achieved by providing at least one drive motor that has a drive connection to further cylinders via the impression cylinder. It is possible to provide further motors that, depending on the design, can perform only set-up functions. Such further motors are therefore designated auxiliary motors but they also can be used during printing operations as additional drive motors. These further or auxiliary motors drive the printing mechanism either via the transfer cylinder, the form cylinder, the inking unit or the damping unit.

If a plurality of motors are provided that can be operable during printing operations, stress torques are avoided or reduced, by a mechanical drive connection between these motors, that is operable or effective at least during the printing operations. For example, a mechanical drive connection can be provided at least during a printing operation between the drive motor driving the impression cylinder and at least one further drive motor that is assigned to an associated printing mechanism. This arrangement produces mechanical synchronization of the motors. As a result, the internally acting stress torques cannot additionally load the two drive motors. The drive motor that drives the impression cylinder can therefore be designed with a lower motor output and torque than would otherwise be necessary. If a clutch is provided in the mechanical drive train associated with the mechanical drive connection, the clutch is engaged during printing operation of the associated printing mechanism so that the synchronization provided by the mechanical drive connection is ensured.

If there is at least one further drive motor of an associated printing mechanism in addition to the drive motor driving the impression cylinder, then if one drive motor fails, the printing unit can continue to be driven in an emergency mode during the printing process. In order to provide such emergency operation, the printing mechanism and the impression cylinder must have a mechanical drive connection during the printing process.

According to another aspect of the invention, two printing mechanisms are provided with a common impression cylinder. Thus, the two printing mechanisms can be operated by only one drive motor, which drives the impression cylinder (FIG. 1). Further drive motors, each of which is assigned to a corresponding printing mechanism also can be provided. During printing operations, at least one of the further drive motors has a mechanical drive connection to the drive motor that drives the impression cylinder (FIG. 1*a* and FIG. 1*b*).

According to a further aspect of the invention, in order to form a 10-cylinder printing unit, two impression cylinders that are facing each other can be provided with each impression cylinder being assigned to two printing mechanisms. In such a printing unit, each impression cylinder can be assigned a drive motor (FIG. 1) or the two impression cylinders can have a common drive motor (FIG. 2). Further drive motors are also possible. Each of the further drive motors can be assigned to a printing mechanism and during printing operations at least one of the further drive motors can have a mechanical drive connection to the drive motor that drives the impression cylinder (FIG. 1*c*).

According to another aspect of the invention, three or four printing mechanisms can be arranged around a common impression cylinder. Even with such an arrangement, only one drive motor is needed to drive the three or four printing mechanisms (FIG. 3). With this arrangement, further drive motors also can be provided, with each further drive motor being assigned to a printing mechanism. During printing operations, at least one of the further drive motors has a mechanical drive connection to the drive motor that drives the impression cylinder (FIG. 21, FIG. 23).

An impression cylinder can be assigned to a plurality of printing mechanisms. The drive motor assigned to the impression cylinder in this case also drives the printing mechanisms, each comprising a transfer cylinder, a form cylinder and an inking and damping unit, that have a mechanical drive connection to the impression cylinder. Further printing mechanisms, which do not have a mechanical drive connection to this impression cylinder but which use the same impression cylinder and are driven by a dedicated drive motor, are also possible (FIG. 20). In this case, it is expedient for these further printing mechanisms to be coupled to the impression cylinder during the printing process. This ensures that the stress torques acting within the printing unit do not additionally load the drive motors (FIG. 20*a*).

A further embodiment provides for two printing mechanisms to be provided, which have an impression cylinder driven by a first drive motor and at least one transfer cylinder with a form cylinder downstream, which can be driven by a second drive motor and can be set against the impression cylinder. The connecting gears of the cylinders of the two printing mechanisms can be arranged in one plane and the connecting gears of the other cylinders can be arranged in a second plane parallel thereto (FIG. 4 to FIG. 7). In this case, the second drive motor advantageously has a mechanical drive connection to the first drive motor during printing operation so that the drive motors are not loaded by the stress torque acting within the printing mechanism. If a clutch is provided for uncoupling a printing unit, the clutch must be engaged during printing operation of the associated printing mechanism (FIG. 8).

It is also possible to use one of the two drive motors merely as an auxiliary motor for set-up purposes. This auxiliary motor then can be designed with a substantially smaller motor output and torque. In such a case, it is advantageous to uncouple and stop the auxiliary motor during printing operation. A clutch can be used to couple the transfer cylinder and its downstream form cylinder, which are not connected mechanically to the impression cylinder, to the impression cylinder (FIG. 8*a*).

According to a further aspect of the invention, the drive motor can drives the shaft of the impression cylinder directly. Alternatively, a gear train can be arranged between the drive motor and the impression cylinder. With such a configuration, the location at which the drive motor is installed can be chosen relatively freely and the motor speed can differ from the rotational speed of the impression cylinder.

A clutch advantageously can be arranged between the impression cylinder and the drive motor assigned to the impression cylinder. As a result, it is possible to use the drive motor to rotate the printing mechanisms connected to it without the impression cylinder co-rotating when the clutch is disengaged. This may be necessary, for example, if the paper web to be printed is wrapped around the impression cylinder (FIG. 22).

An isolating clutch advantageously can be provided between each impression cylinder and at least one component driven by the impression cylinder. As a result, it is possible to disconnect the further cylinders and/or, if appropriate, an inking and/or damping unit, from the drive motor that drives at the impression cylinder if these are not needed during the printing process or are to be changed over.

The components that can be disconnected then can preferably be driven by a further drive motor. In the uncoupled state, the disconnected components can be driven separately for set-up functions. In the coupled state, the motor serves as an additional drive motor. The engaged isolating clutch ensures that the stress torque acting within the printing unit does not additionally load the drive motors.

By coupling up the further drive motor, the drive motor that drives the impression cylinder can be designed with a smaller motor output than otherwise would be necessary. In the event of a failure of the drive motor, the printing unit can continue to be driven in an emergency mode with the aid of the other drive motor. In such a case, the isolating clutch between the impression cylinder and the drive motor driving the printing mechanism must be engaged. The isolating clutch can be a register-maintaining clutch having at least one defined coupling position and/or a clutch that can be engaged in any desired position, such as, for example, a friction clutch.

With the isolating clutches engaged, the advantage that the drive motors can be designed with a smaller motor output and motor torque, since the drive motors are no longer additionally loaded by the stress torques acting within the printing unit because of the mechanical synchronization, is achieved, particularly with web-fed rotary offset presses. Likewise, it is possible that if a drive motor fails, the printing unit can continue to be driven in an emergency mode by the other drive motors.

A further isolating clutch is expediently provided between a further motor and the subassembly that can be disconnected. Therefore, the further motor does not have to co-rotate during printing operation. In such a case, the further motor is an auxiliary motor, which has to drive the disconnected components only for set-up functions and at a relatively low rotational speed. Thus, the auxiliary motor can be designed in a cost effective manner and with lower output and lower torque.

With an engaged isolating clutch located between the impression cylinder and a cylinder that can be uncoupled from the latter, the form cylinder needs to be able to rotate for the adjustment of the circumferential register. This can be accomplished, for example, by an axial displacement of a transfer cylinder and/or a form cylinder with a rotational movement of the form cylinder being derived from the axial displacement via an obliquely toothed gear that is fixed on the shaft of the displaceable cylinder. The rotational movement of the form cylinder can also be produced by an obliquely toothed gear that is pushed axially onto the shaft of the transfer cylinder or the form cylinder. In this case, the gear that is fixed on the shaft of the displaceable cylinder, or the axially displaceable, obliquely toothed gear engages a further obliquely toothed gear that is situated on an adjacent cylinder, and is not affected by the circumferential register adjustment and maintains its position.

However, the adjustment of the circumferential register of a printing mechanism that has a mechanical drive connection to the impression cylinder, can also be made with the aid of the drive motor that drives impression cylinder and/or, possibly, further drive motors assigned to these printing mechanisms. In such a case, the impression cylinder is rotated by the adjustment of the circumferential register. When the isolating clutch between the impression cylinder and a cylinder that can be uncoupled from the impression cylinder is disengaged or when the isolating clutch is relieved of load, which is possible in the case of a friction clutch, a form cylinder can be rotated by the further drive motor assigned to the form cylinder for the adjustment of the circumferential register.

The aspect of the invention relating to possible adjustments for the circumferential register have particular application in web-fed rotary offset presses.

DETAILED DESCRIPTION OF THE INVENTION

Figure 1:
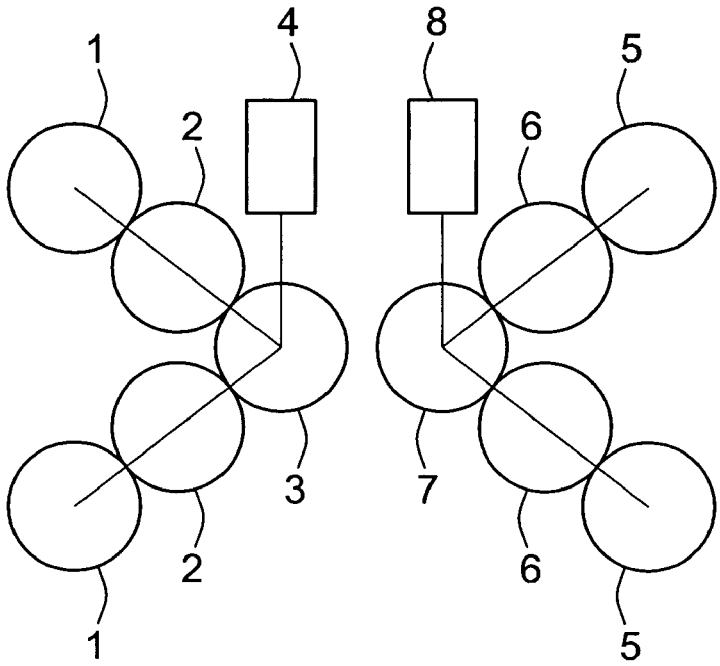
FIG. 1 is a schematic drawing of an exemplary printing unit including multiple printing mechanisms and having a drive arrangement according to the present invention.

FIG. 1 illustrates (on the left-hand side) two printing mechanisms each having a form cylinder 1 and a transfer cylinder 2. The transfer cylinders 2 rest on a common impression cylinder 3. A drive motor 4 can drive the impression cylinder 3. The drive motor 4 can, for example, be rigidly fitted to the shaft of the transfer cylinder or connected to this shaft, rigidly or via a clutch. The impression cylinder 1 drives the cylinders 1 and 2 in a known manner by means of connecting gears.

As further shown in FIG. 1, the two printing mechanisms can be extended by means of two additional printing mechanisms arranged opposite each other. Each of the additional print mechanisms has two form cylinders 5 and two transfer cylinders 6 that rest on a common impression cylinder 7 and are driven by a drive motor 8 so as to form a 10-cylinder printing unit in which the two impression cylinders 3, 7 face each other.

Figure 1A:
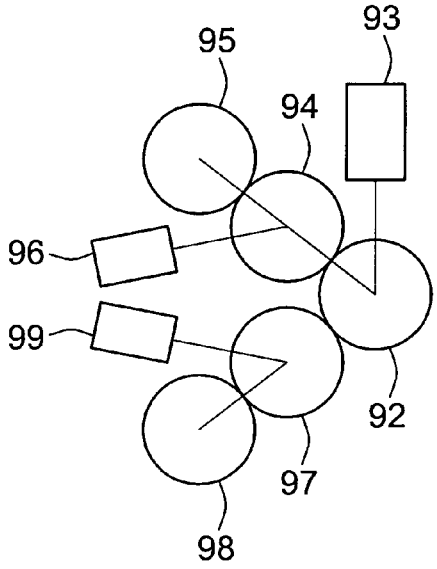
FIGS. 1*a* and 1*b* are schematic drawings of a further embodiment of a printing unit including multiple printing mechanisms and having a drive arrangement according to the present invention.
Figure 1B:
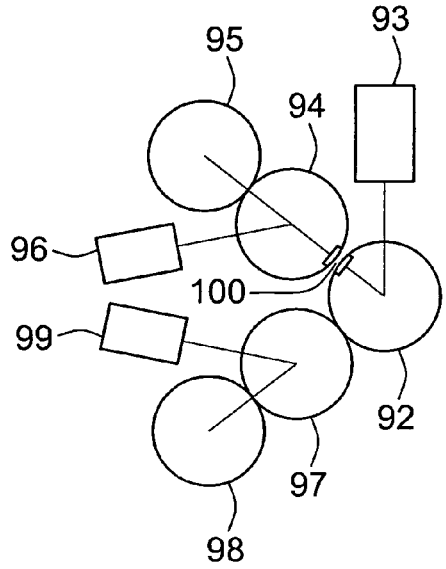

FIGS. 1*a* and 1*b* illustrate a printing unit comprising two printing mechanisms that use a common impression cylinder 92. A drive motor 93 drives the impression cylinder 92 and at least one printing mechanism, comprising a transfer cylinder 94 and a form cylinder 95, has a mechanical drive connection to the impression cylinder 92. The printing mechanism (including cylinders 94, 95) mechanically connected to the impression cylinder 92 can include an additional drive motor 96. The stress torques that arise between the mechanically connected printing mechanism including cylinders 94, 95 and the mechanically connected impression cylinder 92 do not load the associated drive motors 93 and 96. The impression cylinder 92 can be assigned further printing mechanisms that, in turn, comprise a transfer cylinder 97 and a form cylinder 98, which do not have a mechanical drive connection to the impression cylinder 92 and are driven by a dedicated motor 99. Stress torques that arise between the printing mechanism (including cylinders 97, 98) that is not connected mechanically to the impression cylinder 92 and the impression cylinder 92 load either the mechanically connected motors 93 and 96 or the motor 99, depending on the diameter relationships between the impression cylinder 92 and the transfer cylinder 97.

As shown in FIG. 1*b*, the mechanical drive connection between the printing mechanism including cylinders 94, 95 and the impression cylinder 92 can have a clutch 100, which is engaged during printing operation, in order not to load the associated motors 93, 96 with the stress torque between the printing mechanism and the corresponding impression cylinder. The clutch 100, for example, can be disengaged during changeover operation in order to move the printing mechanism including cylinders 94, 95 independently with the associated motor 96 for set-up work.

Figure 1C:
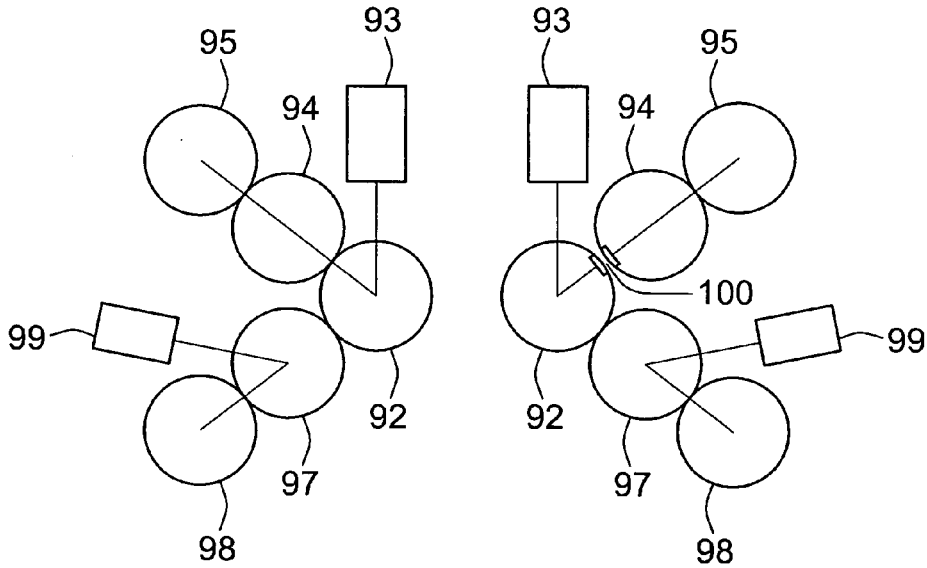
FIG. 1*c* is a schematic drawing of a further embodiment of a printing unit including multiple printing mechanisms and having a drive arrangement according to the present invention.
Figure 2:
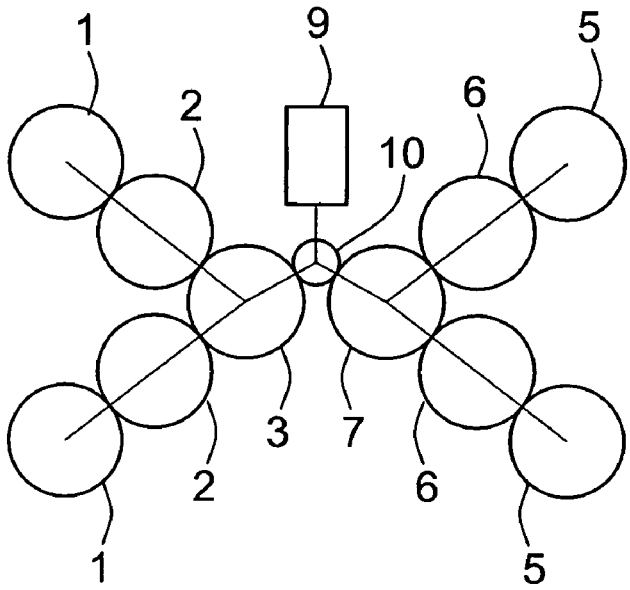
FIG. 2 is a schematic drawing showing a further variant of the drive of the printing unit of FIG. 1*c*.

FIG. 1*c* illustrates a 10-cylinder H printing unit that substantially consists of the combination of the printing units shown in FIGS. 1*a* and 1*b*. Only the printing mechanisms including cylinders 94, 95 that have a mechanical connection to the impression cylinder 92 do not have a dedicated drive motor 96. A further variant of the drive for this 10-cylinder printing unit is shown by FIG. 2. In the embodiment shown in FIG. 2, only one drive motor 9 is provided. The drive motor 9 has a simultaneous drive connection to both impression cylinders 3, 7 via a gear train 10 (shown schematically). The gear train 10 can be formed by a plurality of interengaging gears or a belt or chain drive.

If only 3-color printing is desired, one transfer cylinder (e.g., transfer cylinder 6) and the associated form cylinder 5 can be eliminated.

Figure 3:
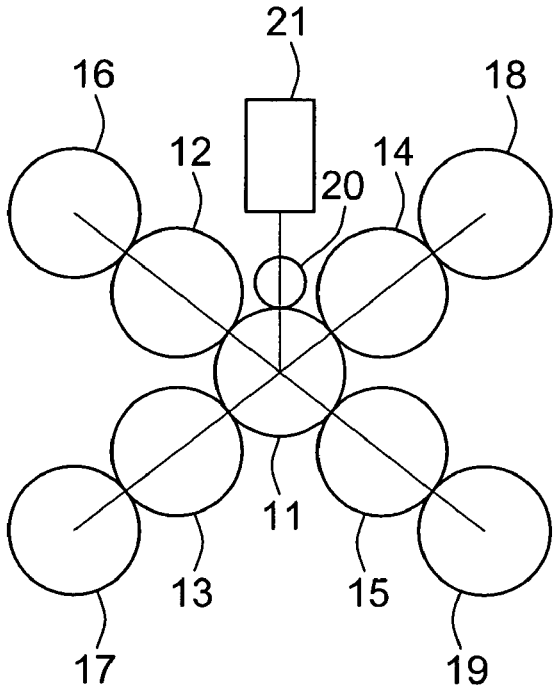
FIG. 3 is a schematic drawing of a further embodiment of a printing unit including multiple printing mechanisms and having a drive arrangement according to the present invention.

A 9-cylinder printing unit is illustrated in FIG. 3. In the FIG. 3 embodiment, a central impression cylinder 11 is provided, on which four transfer cylinders 12-15 rest. Each of the transfer cylinders 12-15 is, in turn, in contact with a form cylinder 16-19. The impression cylinder 11 is connected to a drive motor 21 via a gear train 20 (shown schematically).

Figure 4:
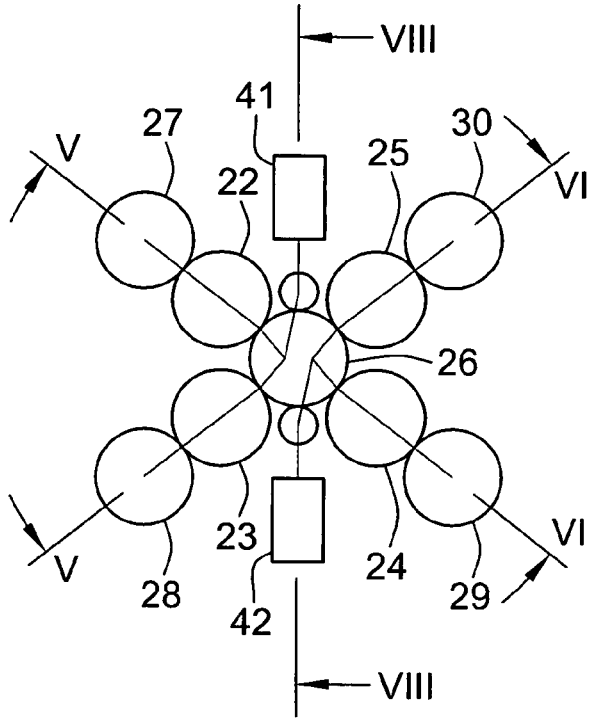
FIG. 4 is a schematic drawing of a further embodiment of a printing unit including multiple printing mechanisms and having a drive arrangement according to the present invention.
Figure 5:
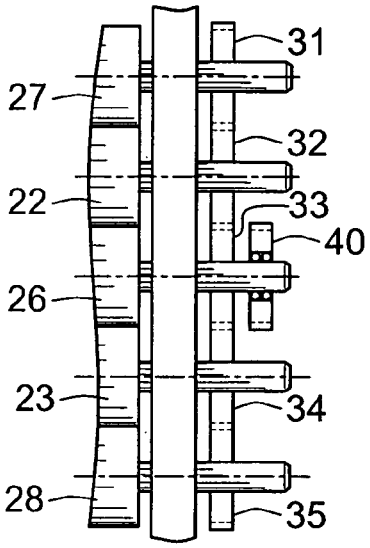
FIG. 5 is a cross-sectional view of the printing unit of FIG. 4 taken along the line V-V in FIG. 4.

An alternative for the drive of a 9-cylinder printing unit is shown in FIG. 4. In the FIG. 4 embodiment, four transfer cylinders 22-25 again are in contact with a common impression cylinder 26. A form cylinder 27-30 rests on each of the transfer cylinders 22-25. As shown in FIG. 5 (which is a cross-sectional view along the line V-V in FIG. 4), a connecting gear 31-35 is seated firmly on the shaft of each cylinder 27, 22, 26, 23 and 28. These gears lie in a common plane and intermesh with each other.

Figure 6:
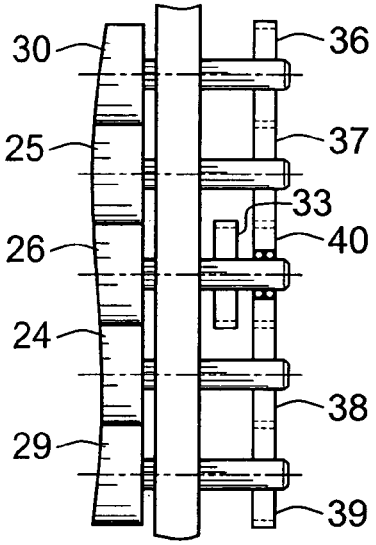
FIG. 6 is a cross-sectional view of the printing unit of FIG. 4 taken along the line VI-VI in FIG. 4.

As shown in FIG. 6 (which is a cross-sectional view taken along the line VI-VI in FIG. 4), a connecting gear 36-39 is firmly seated on each of the cylinders 30, 25, 24, 29. These gears are arranged in a plane that is offset laterally with respect to the connecting gears 31-35. In this case, the connecting gears 37, 38 mesh with a further connecting gear 40 fitted loosely on the shaft of the impression cylinder 26.

Figure 7:
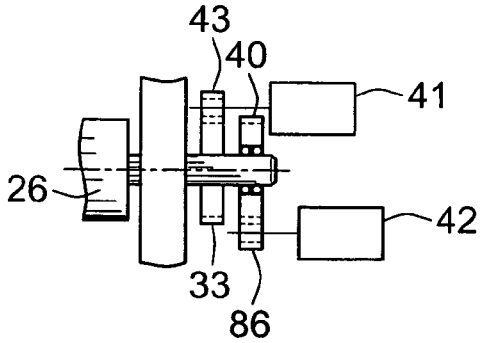
FIG. 7 is a schematic view of a portion of the drive arrangement of the printing unit of FIG. 4.
Figure 4A:
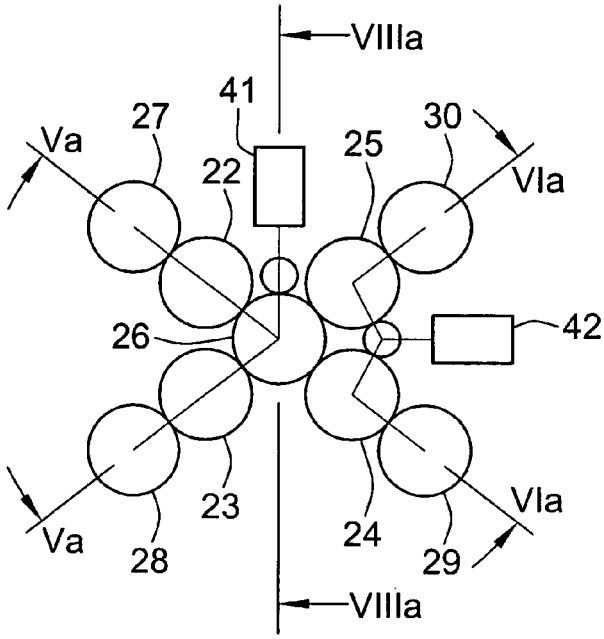
FIGS. 4*a*, 5*a*, 6*a* and 7*a* are views corresponding to FIGS. 4-7 of a variant of the printing unit embodiment of FIG. 4.
Figure 5A:
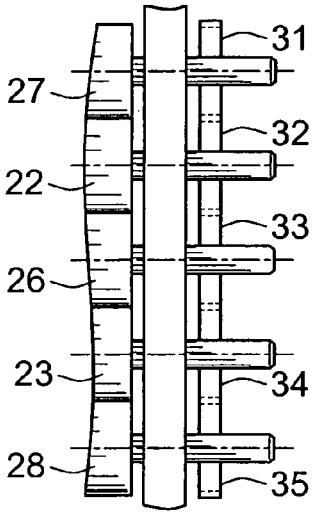
Figure 6A:
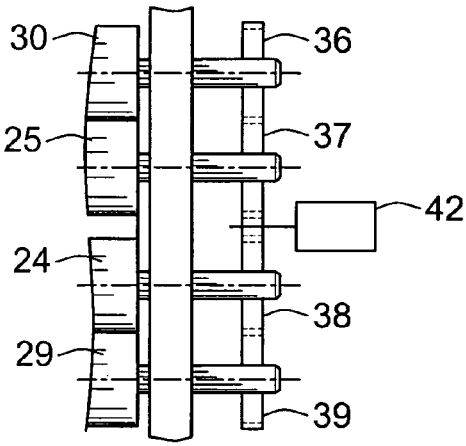
Figure 7A:
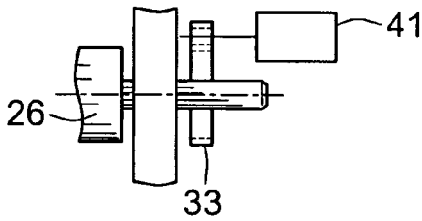

As shown in FIG. 7, a drive motor 41 drives the connecting gear 33 fitted firmly on the shaft of the impression cylinder 26 via a gear train 43 (shown schematically). A further drive motor 42 drives the connecting gear 40 fitted loosely on the shaft of the impression cylinder 26 via a gear train 86 (shown schematically). The gear trains 43 and 86 can comprise a plurality of interengaging gears or belt or chain drives. In this arrangement, the two printing mechanisms having the transfer cylinders 22, 23 are driven by the drive motor 41, while the cylinders 24, 29, 25, 30 can be set off. All the printing mechanisms of this printing unit can print as a result of the drive motor 42 being switched on.

In the variant described above and illustrated in FIG. 4, it is not absolutely necessary for the connecting gear 40 to be fitted on the shaft of the impression cylinder 26. Likewise, it is not necessary for the connecting gear 40 to have the same number of teeth as the connecting gear 33; nor does the connecting gear 40 have to be arranged coaxially with respect to the impression cylinder 26 (see, e.g., FIGS. 4*a*, 5*a*, 6*a*, 7*a*).

Figure 8:
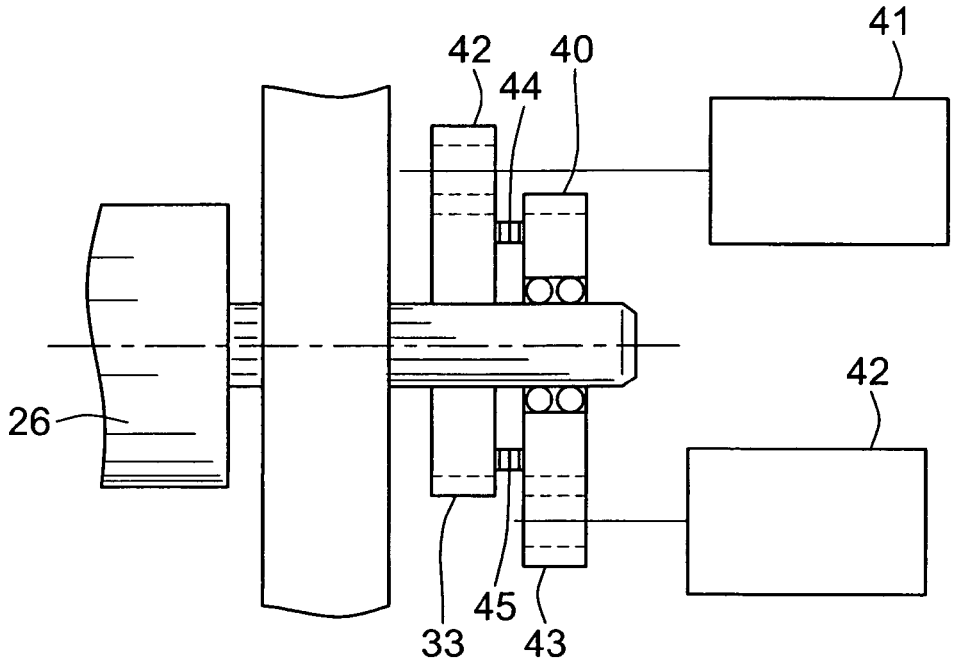
FIG. 8 is a schematic view of a further embodiment of the drive arrangement for the printing unit of FIG. 4.
Figure 8A:
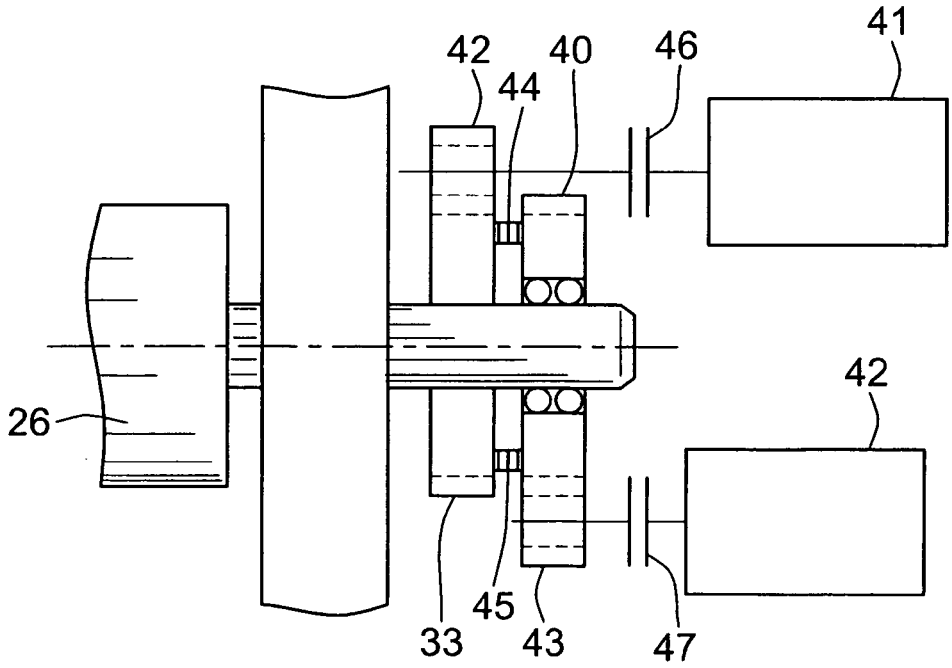
FIG. 8*a* is a schematic view of a variant of the drive arrangement of FIG. 8.

As shown in FIG. 8, in a further refinement of this arrangement, the connecting gear 40 can be coupled to the impression cylinder 26. In FIG. 8, the coupling is illustrated schematically in that, for example, the connecting gear 40 is mounted such that it can be displaced axially and has coupling elements 44 that, as a result of the axial displacement, engage the matching coupling elements 45 on the connecting gear 33 on the shaft of the impression cylinder 26. In this way, it is possible to use the drive motor 41 and the drive motor 42 jointly to drive the 9-cylinder printing unit with the coupling elements 44, 45 engaged. By means of the engaged coupling elements, the internally acting stress torque no longer loads the two drive motors. Moreover, it is possible to provide an isolating clutch 46, 47 between the drive motor 41 and the connecting gear 33 and/or the further drive motor 42 and the connecting gear 40 (see FIG. 8*a*). The drive motor 41 or the drive motor 42 could then be a pure auxiliary motor that is used only for set-up tasks and that is uncoupled by the clutch 46 or 47 during printing operation.

Figure 9:
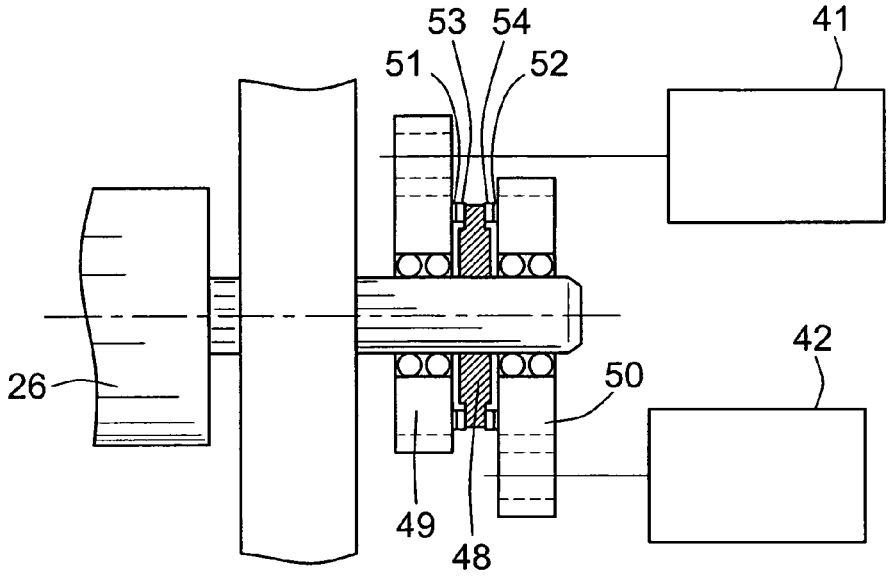
FIG. 9 is a schematic view of another variant of the drive arrangement of FIG. 8.

A variant of the arrangement of FIG. 8 is shown in FIG. 9. Here, the impression cylinder 26 can be uncoupled from the drive motor 41 and/or 42 and therefore from the printing mechanisms assigned to it. In this variant, it is possible for the impression cylinder to remain at a standstill while the printing mechanisms are rotated by the motors 41 and/or 42. This can be useful, for example, when the printing mechanisms are being set up and the impression cylinder has an already threaded paper web wrapped around it.

The clutch 51-54 is illustrated schematically in FIG. 9 with a clutch disc 48 firmly fitted to the shaft of the impression cylinder 26. A connecting gear 49, 50 is placed on the shaft of the impression cylinder 26 on either side of the clutch disc 48 such that it can rotate freely and be displaced axially. In this case, the connecting gear 49 again meshes with the connecting gears 32, 34, and the connecting gear 50 meshes with the connecting gears 37, 38. The connecting gears 49, 50 have clutch elements 51, 52 on their side facing the clutch disc 48. These clutch elements 51, 52 can optionally be brought into engagement with matching clutch elements 53, 54 belonging to the clutch disc 48 by means of axial displacement of the gears 49, 50. It is possible both to drive the cylinders 27, 22, 26, 23, 28 and also the cylinders 29, 24, 26, 25 and 30 separately and to drive all the connecting gears jointly. In this case, further isolating clutches between the motor 41 and the connecting gear 49 and/or between the motor 42 and the connecting gear 50 are also possible, if the motor 41 or the motor 42 is designed as a pure auxiliary drive and is uncoupled during printing operation. Moreover, the cylinders 25 and 30 and/or the cylinders 22 and 27 can be left out if desired.

Figure 19:
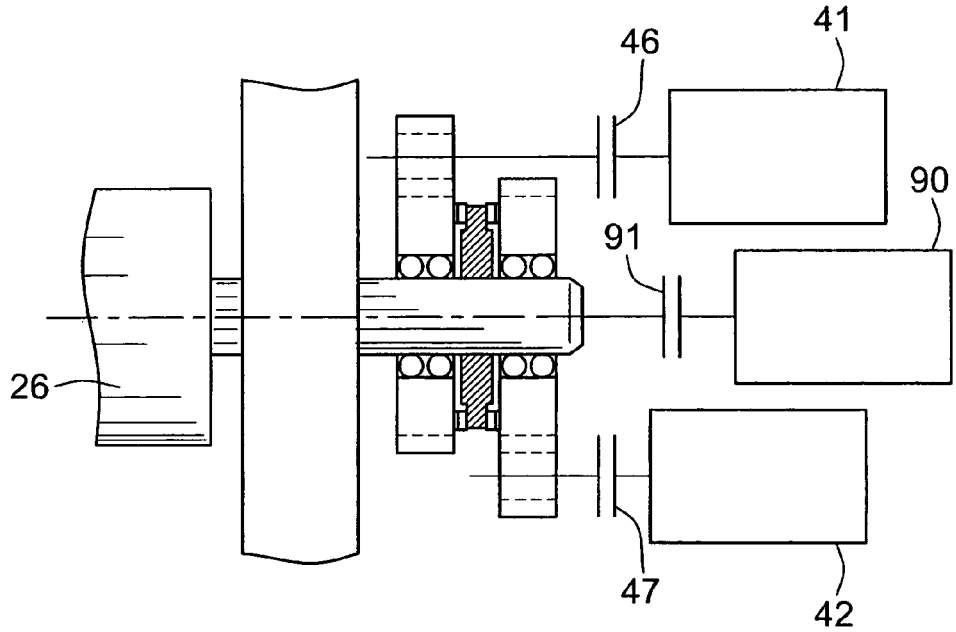
FIG. 19 is a schematic view of a variant of the drive arrangement of FIG. 9.

A variant of the arrangement of FIG. 9 is shown in FIG. 19. In the FIG. 19 arrangement, a further motor 90 can drive the impression cylinder. An isolating clutch 91 can be provided between this further motor 90 and the impression cylinder 24. In a similar way to the FIG. 8*a* embodiment, clutches 46, 47, 91 can be arranged downstream of all the motors 41, 42, 90. In the FIG. 19 arrangement, the impression cylinder can be rotated by the motor 90 assigned to it while the printing mechanisms are rotated by their associated motors 41, 42. This can be necessary, for example, if a paper web is being pulled through the printing unit, the motor 90 is driving the impression cylinder and, at the same time, the printing mechanisms with their associated motors 41 and 42 are being set up. The motor 90 can be a drive motor that likewise drives the printing unit during printing operation. In this case, the isolating clutch 91 is engaged or the isolating clutch is not needed. The engaged isolating clutch 91 ensures that the stress torques acting within the printing unit do not additionally load the drive motors. However, the motor can also be a pure auxiliary motor that is uncoupled by means of the clutch 91 during printing operation. The motor 90 can, for example, be fitted rigidly to the shaft of the transfer cylinder or can be connected to this shaft, rigidly or via a clutch 91. However, the motor 90 can also drive the impression cylinder via a gear train, for example via a gear fixed to the impression cylinder or via a belt or chain drive.

Figure 10:
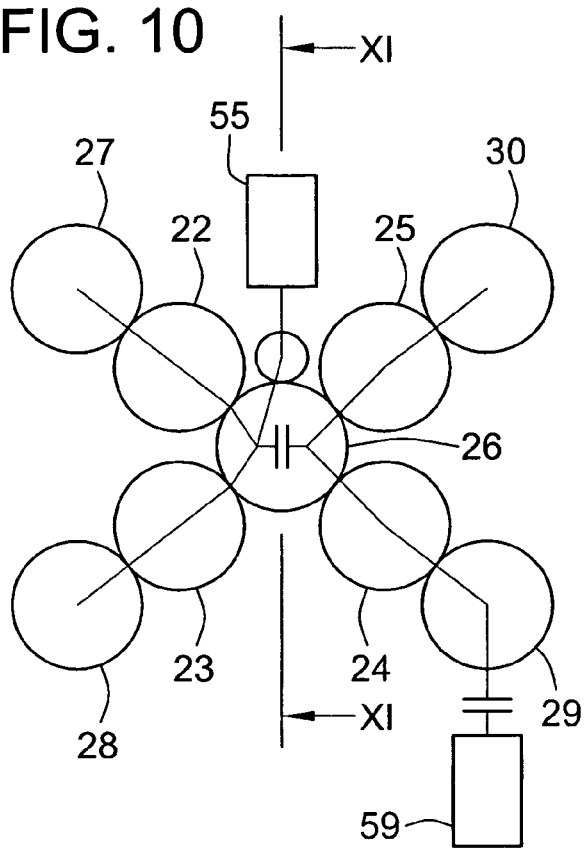
FIG. 10 is a schematic drawing of a further embodiment of a printing unit including multiple printing mechanisms and having a drive arrangement according to the present invention.
Figure 11:
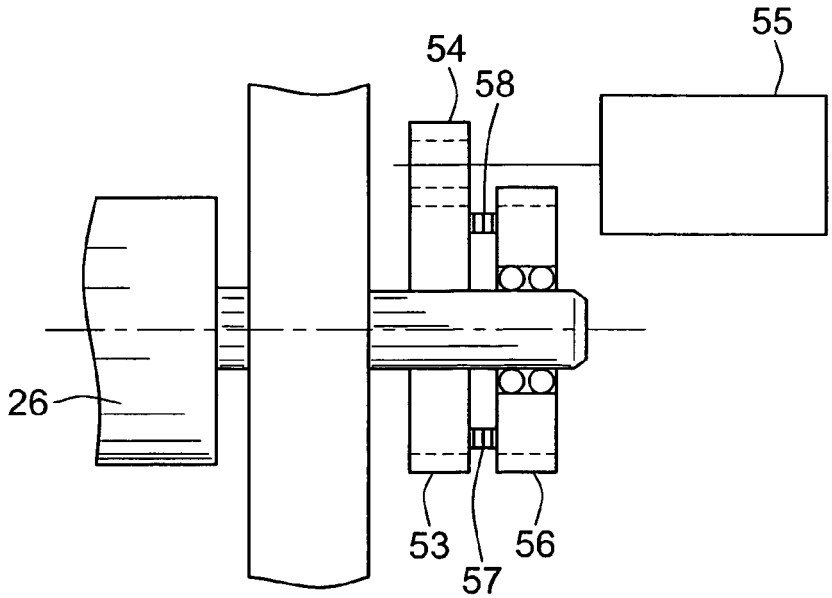
FIG. 11 is a schematic view of the drive arrangement of the printing unit of FIG. 10.

FIGS. 10 and 11 illustrate a further variant of the drive of a 9-cylinder printing unit. The embodiment of FIGS. 10 and 11 is generally based on the embodiments of FIGS. 4, 5, 6, 7, 8, 8*a*, 9, 19 except that the motor 59, as opposed to the motor 42, drives the form cylinder 29. It is also possible for the motor 59 to drive the other form cylinder 30, the transfer cylinder 24 or 25, an inking unit or a damping unit, which are assigned to the form cylinders 29 or 30.

The further motor 59 can either be fitted rigidly to the shaft of the driven form or transfer cylinder or ink or damping solution distributor, or connected to this shaft, rigidly or via a clutch. However, the further motor 59 can also drive the form or transfer cylinder or the inking or damping unit via a gear train or via a belt or chain drive.

Further details of the printing units described above can be understood from the following description.

Figure 12:
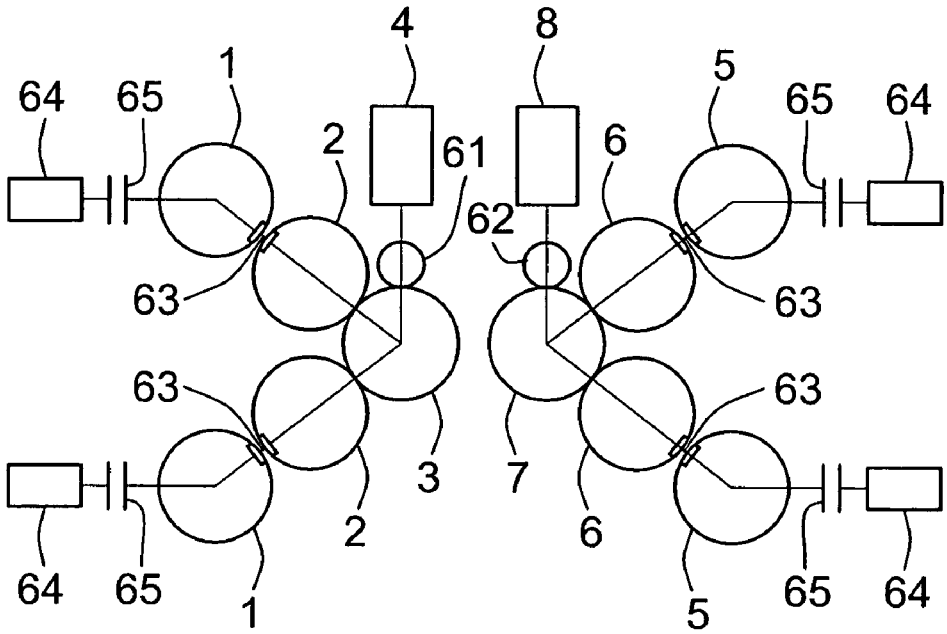
FIG. 12 is a schematic view of another embodiment of a printing unit including a drive arrangement according to the present invention that is based on the embodiment of FIG. 1.

The embodiment of FIG. 12 is based on the basic structure of FIG. 1, except that in the FIG. 12 embodiment, the drive motors 4, 8 each have a drive connection to the impression cylinders 3, 7 via a gear train 61, 62 (shown schematically). In addition, an isolating clutch 63 is provided between the transfer cylinders 2, 6 and respectively associated form cylinders 1, 5 for interrupting the drive connection between the transfer cylinders 2, 6. In this case, each of the form cylinders 1, 5 can be driven by a further motor 64. In the illustrated embodiment, isolating clutches 65 are additionally provided between each further motor 64 and the associated form cylinder 1 or 5. Therefore, during printing operations, the further motors 64 can be disconnected if the motors are pure auxiliary motors. If these further motors are designed in such a way that they can revolve with the cylinders while idling, the isolating clutch 65 can be eliminated.

It is likewise possible to dispense with the isolating clutches 65 if the further motors are drive motors that also drive the printing mechanism during printing operations. The isolating clutches 63 are then engaged during printing operation. This ensures that the stress torques acting within the printing unit do not additionally load the drive motors. The drive of a printing mechanism with a further motor 64 is provided via a form cylinder 1 or 5, or via a transfer cylinder 2 or 6 or via an associated inking or damping unit. The further motors 64 can either be fitted to the shafts of the driven form or transfer cylinder or inking or damping solution distributor or connected to this shaft, fixedly or via a clutch. However, the further motors 64 can also drive the form or transfer cylinder or the inking or damping units via gear trains, for example via gears or via belt or chain drives.

Figure 13:
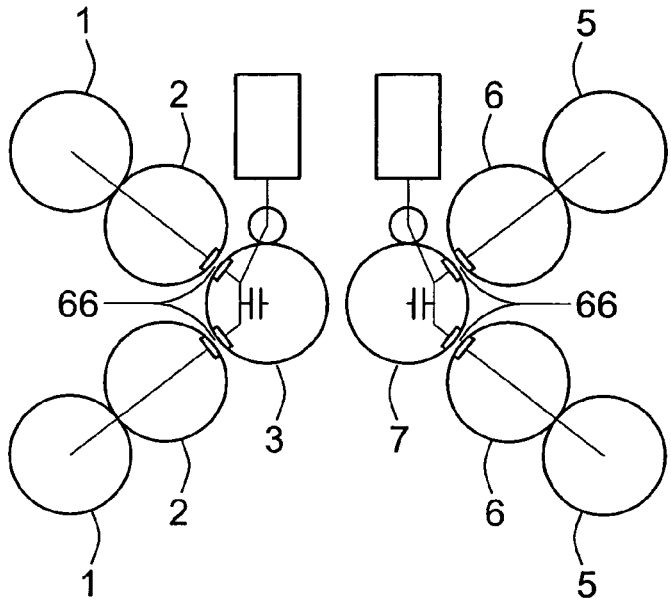
FIG. 13 is a schematic view of another embodiment of a printing unit including a drive arrangement according to the present invention that is based on the embodiment of FIG. 1.

As shown in FIG. 13, which again is based on the basic arrangement according to FIG. 1, that the isolating clutches 66 can also be arranged between the impression cylinders 3, 7 and the transfer cylinders 2, 6. This arrangement permits a transfer cylinder, for example transfer cylinder 2, with the associated form cylinder 1 to be disconnected for changeover or if is not needed, while the press continues to print in three colors with the remaining transfer cylinders 2, 6. In all the embodiment of the invention in which there is no further motor, it is advantageous if the impression cylinder can be uncoupled from the drive motor by means of the clutch. This is particularly advantageous when, for example, the paper web is wrapped around the impression cylinder and the printing mechanisms have to be rotated at the same time for set-up operations, without the impression cylinder rotating in the process.

Figure 14:
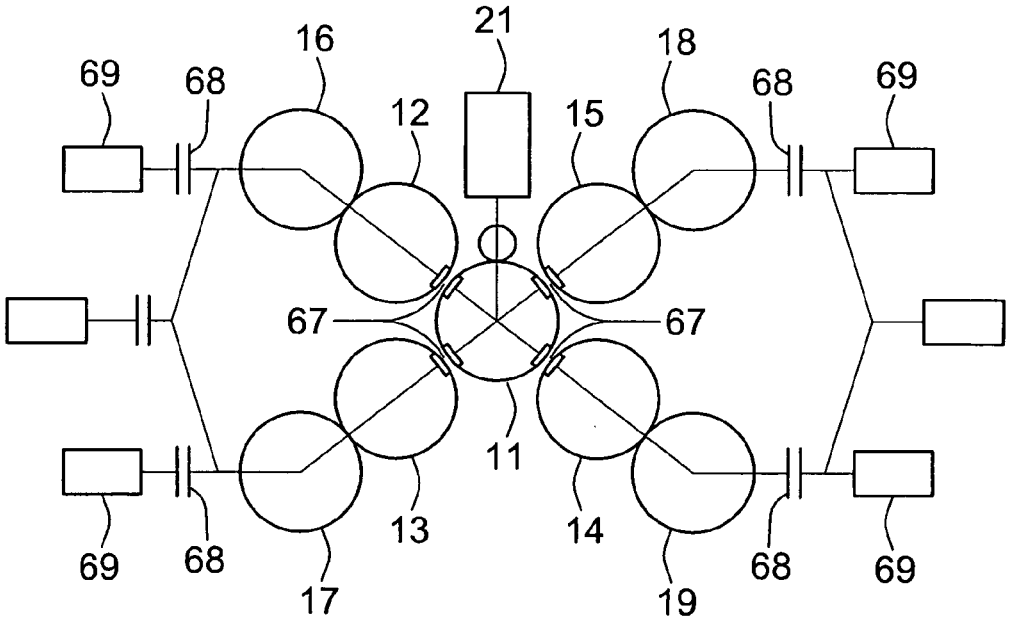
FIG. 14 is a schematic view of another embodiment of a printing unit including a drive arrangement according to the present invention that is based on the embodiment of FIG. 3.

The printing unit embodiment illustrated in FIG. 14 is based on the basic arrangement of FIG. 3. In addition to what is provided in the FIG. 3 embodiment, isolating clutches 67 are arranged between the single impression cylinder 11 and the transfer cylinders 12 to 15. These isolating clutches 67 can be used to interrupt the drive connection from the impression cylinder 11, which is driven by means of the drive motor 21. Furthermore, for the purpose of changeover, each form cylinder 16 to 19 can be driven via an isolating clutch 68 by a further motor 69. The form cylinders 18 and 19 also can be driven by a common further motor via a clutch in each case for the purpose of changeover. Such an arrangement is illustrated in dashed lines in the right-hand half of FIG. 14. It is also for the form cylinders 16 and 17 to be driven by a common further motor via a common clutch for the purpose of changeover. This is illustrated in the left-hand half of FIG. 14.

In this case of the FIG. 14 embodiment, the further motors 69 can be designed as pure auxiliary motor that can be uncoupled via the isolating clutches 68 during the printing process. However, the isolating clutches can also be eliminated if the further motors 69 are designed in such a way that they are able to co-rotate during operation of the press. It is also possible to dispense with the isolating clutches 68 if the further motors 69 are drive motors that additionally drive the printing mechanism during printing operation. The isolating clutches 67 are engaged during printing operation. This ensures that the stress torques acting within a printing unit do not additionally load the drive motors.

The driving of a printing mechanism with a further motor 69 is carried out either via a form cylinder 16, 17, 18 or 19, via a transfer cylinder 12, 13, 14 or 15 or via an associated inking or damping unit. The further motors 69 can either be fitted rigidly to the shaft of the driven form or transfer cylinder or ink or damping solution distributor or can be connected to the shaft, rigidly or via a clutch. However, the further motors 69 can also drive the form or transfer cylinders or the inking or damping units via gear trains, for example via gears or via belt or chain drives.

Figure 15:
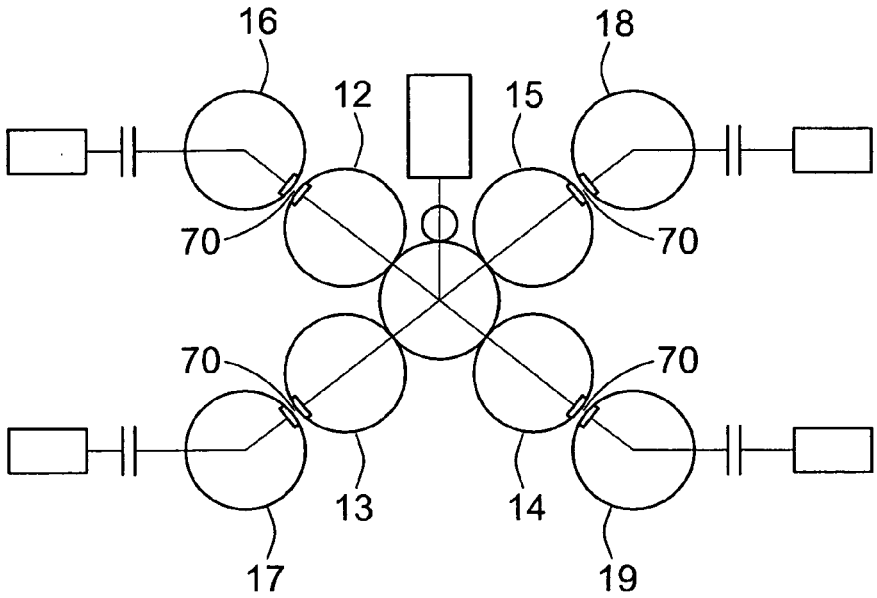
FIG. 15 is a schematic view of another embodiment of a printing unit including a drive arrangement according to the present invention that is a variant of the embodiment of FIG. 14.

As shown in FIG. 15, in the FIG. 14 embodiment, isolating clutches 70 can also be arranged between the transfer cylinders 12 to 15 and the form cylinders 16 to 19. The remaining structure shown in FIG. 15 matches the arrangement according to FIG. 14.

Figure 16:
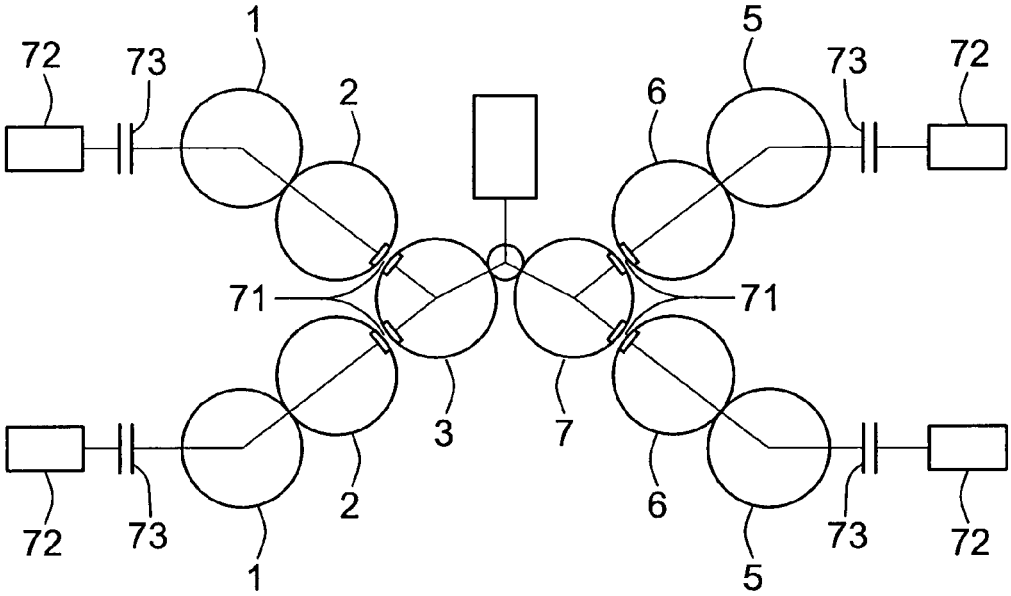
FIG. 16 is a schematic view of another embodiment of a printing unit including a drive arrangement according to the present invention that is based on the embodiment of FIG. 2.

The embodiment of FIG. 16 is based on the basic arrangement according of FIG. 2. In the FIG. 16 embodiment, isolating clutches 71 are provided between the impression cylinders 3, 7 and the transfer cylinders 2, 6. For changeover purposes, each form cylinder 1, 5 can be driven by means of a further motor 72. Isolating clutches 73 are again provided between the further motors 72 and the form cylinders 1, 5. These isolating clutches can again be omitted if the further motors 72 are designed in such a way that they are able to co-rotate during printing operation. If the further motors 72 are designed as pure auxiliary motors, then they can be uncoupled by the isolating clutches 73 during the printing process. It is also possible to dispense with the isolating clutches 73 if the further motors 72 are drive motors that additionally drive the printing mechanisms during printing operation. The isolating clutches 71 must be engaged during printing operation. This ensures that the stress torques acting within a printing unit do not additionally load the drive motors.

The driving of a printing mechanism with a further motor 72 is carried out either via a form cylinder 1 or 5, via a transfer cylinder 2 or 6 or via an associated inking or damping unit. The further motors 72 can either be fitted rigidly to the shafts of the driven form or transfer cylinders or ink or damping solution distributors or can be connected to this shaft, rigidly or via a clutch. The further motors 72 also can drive the form or transfer cylinders or the inking or damping units via gear trains, for example via gears or via belt or chain drives.

Figure 17:
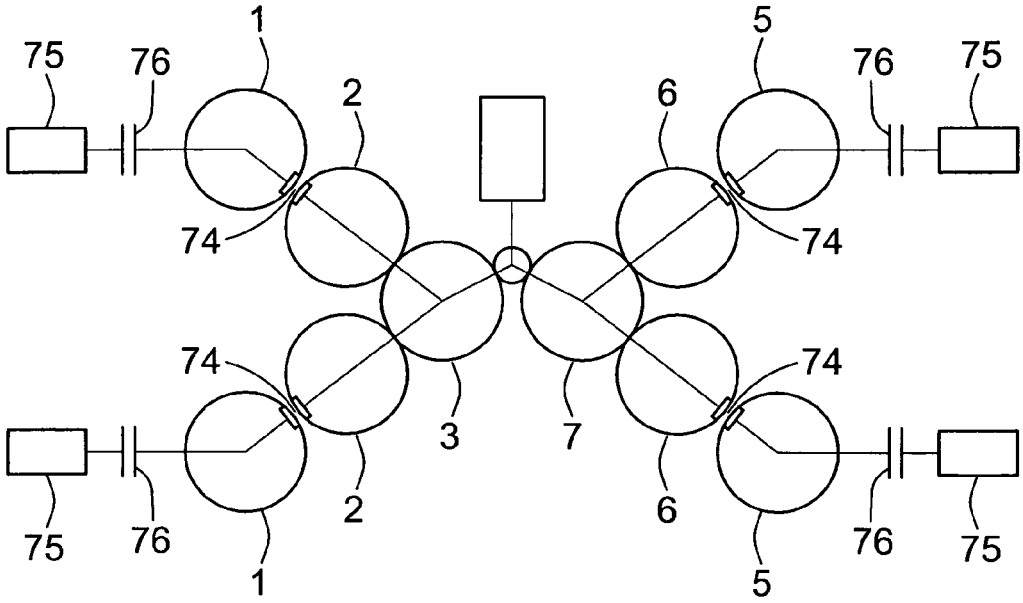
FIG. 17 is a schematic view of another embodiment of a printing unit including a drive arrangement according to the present invention that is based on the embodiment of FIG. 2.

The printing unit embodiment illustrated in FIG. 17 is likewise based on the arrangement of FIG. 2. In the FIG. 17 embodiment, isolating clutches 74 are arranged between the transfer cylinders 2, 6 and the form cylinders 1, 5. Each form cylinder 1, 5 can be driven by a further motor 75, which can either be an auxiliary motor, or by a drive motor, with the interposition of an isolating clutch 76. If desired, it is also possible to provide additional isolating clutches between the impression cylinders 3 and 7 and the transfer cylinders 2, 6. If the further motors are drive motors, then they are not loaded with the stress torques acting within the printing unit if the isolating clutches between the drive motors are engaged.

Figure 18:
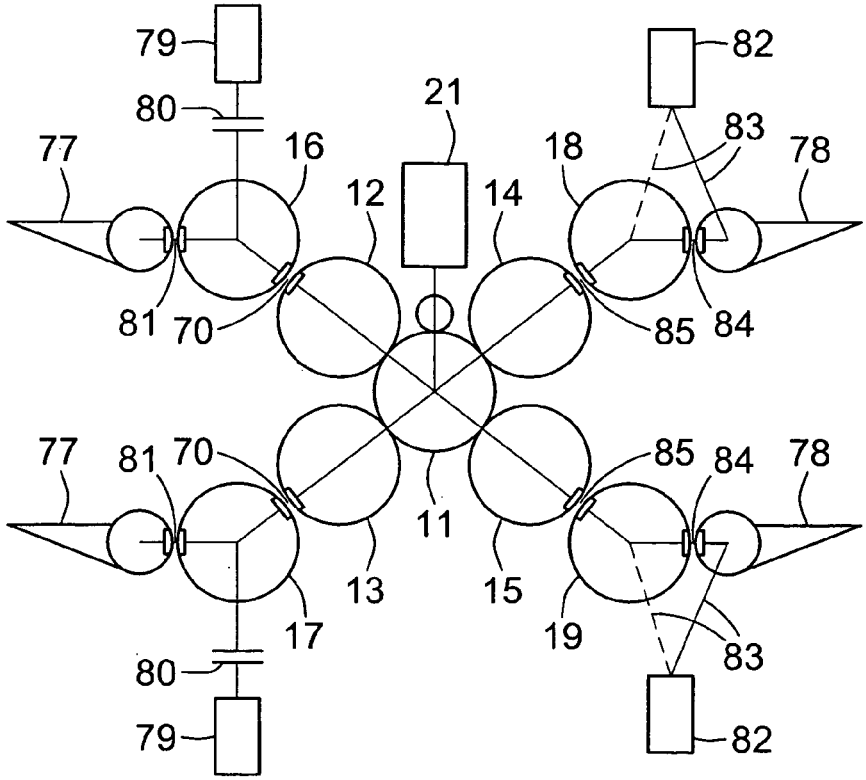
FIG. 18 is a schematic view of another embodiment of a printing unit including a drive arrangement according to the present invention that is based on the embodiment of FIG. 3.

The embodiment of FIG. 18 is based on the basic structure according to FIG. 3. The FIG. 18 embodiment includes two variants of a further motor for an inking and/or damping unit 77, 78. In the arrangement illustrated in the left-hand half of the FIG. 18, a further motor 79 can be connected to a form cylinder 16, 17 via an isolating clutch 80. Each form cylinder 16, 17 can be coupled via a further isolating clutch 81 to the inking and/or damping unit 77 in order to drive the inking and/or damping unit, or can be connected to the drive motor 21 by an isolating clutch 70 via the transfer cylinder 12, 13. In this configuration, it is possible to drive the associated inking and/or damping unit 77 and the form cylinder 16 or 17, or only the form cylinder, via the further motor 79 for changeover work. On the other hand, with the isolating clutches 70, 81 engaged, the inking and/or damping unit 77 is driven by the form cylinder 12 or 13 during the operation of the machine.

In the arrangement illustrated on the right in FIG. 18, further motors 82 can optionally have a drive connection made to the form cylinder 18, 19 or inking and/or damping unit 78 via a changeover mechanism 83. In this case, each form cylinder 18, 19 can be connected to or isolated from the respectively associated transfer cylinder 14, 15 by the isolating clutch 70. A further isolating clutch 84 is expediently provided between each form cylinder 18, 19 and the inking and/or damping unit 78. This arrangement permits the inking and/or damping unit 78 to be rotated freely by the further motor 82 without a form cylinder 18, 19 being moved.

Figure 20:
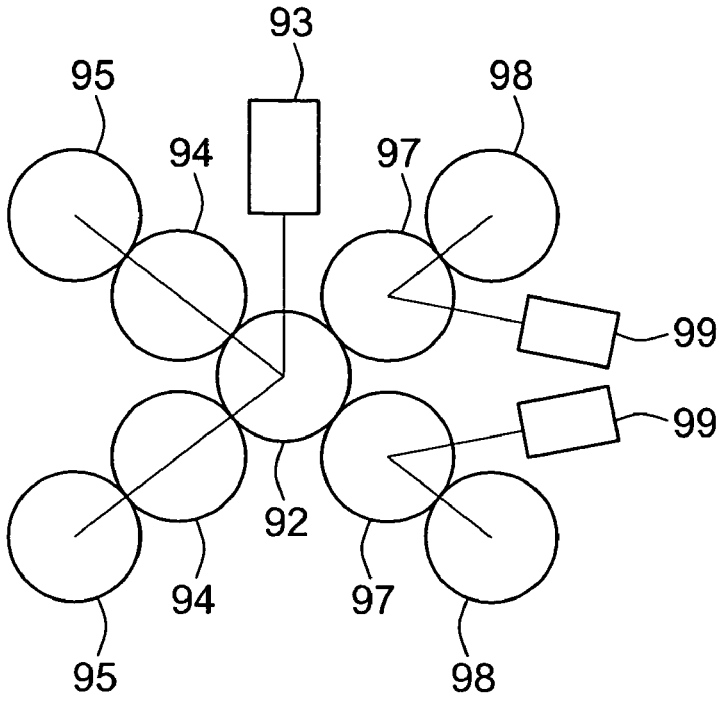
FIG. 20 is a schematic view of another embodiment of a printing unit including a drive arrangement according to the present.

FIG. 20 illustrates a 9-cylinder printing unit comprising four printing mechanisms. Each printing mechanism has a transfer cylinder 94 and a form cylinder 95 or a transfer cylinder 97 and a form cylinder 98, and also a common impression cylinder 92. A drive motor 93 drives the impression cylinder 92. The cylinders 94, 95 (which have a mechanical drive connection to the impression cylinder 92) are likewise driven by the drive motor 93 driving the impression cylinder 92. The stress torques that arise between the mechanically connected printing mechanisms 94, 95 and the mechanically connected impression cylinder 92 do not load the associated drive motor 93. The printing mechanism cylinders 97, 98 that do not have a mechanical drive connection to the impression cylinder 92, are driven in each case by a dedicated drive motor 99. The stress torques that arise between the printing mechanisms 97, 98 not connected mechanically to the impression cylinder 92 and the impression cylinder 92 load the associated drive motors 99 and 93.

Figure 20A:
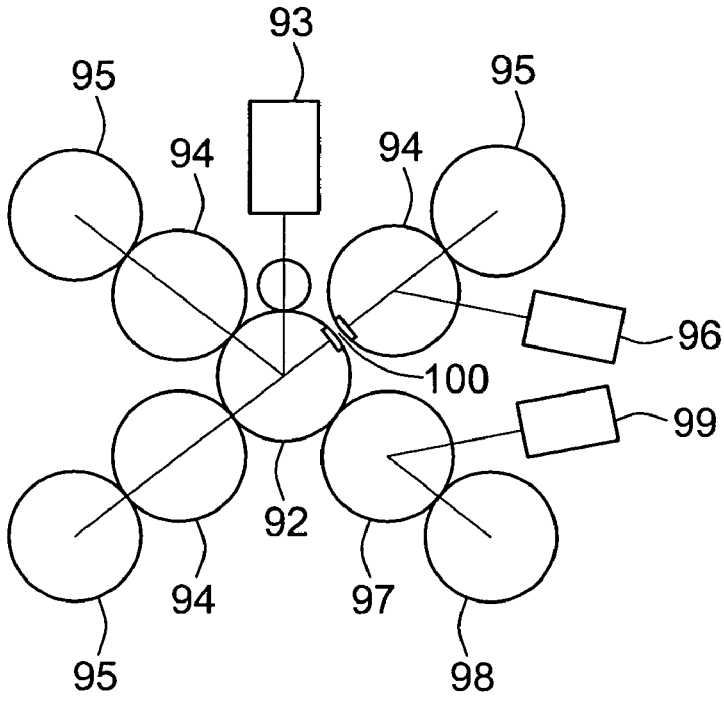
FIG. 20*a* is a schematic view of another embodiment of a printing unit including a drive arrangement according to the present invention that is based on the embodiment of FIG. 20.

The embodiment of FIG. 20*a* is based on the embodiment of FIG. 20. However, the printing mechanisms 97, 98 originally not having a mechanical drive connection to the impression cylinder are connected mechanically to the impression cylinder via a clutch 100 during operation. The associated transfer cylinder is now likewise assigned the reference number 74, the associated form cylinder the number 95 and the associated drive motor the number 96. When the clutch 100 is engaged, the stress torque between the printing mechanism including cylinders 94, 95 and the impression cylinder 92 no longer loads the two drive motors 93 and 96. The stress torque between the printing mechanism including cylinders 97, 98 that does not have a mechanical drive connection to the impression cylinder and the impression cylinder 92 then loads either the two mechanically connected drive motors 93, 96 or the drive motor 99, depending on the diameter ratios of the impression cylinder 92 and the transfer cylinder 97.

Figure 21:
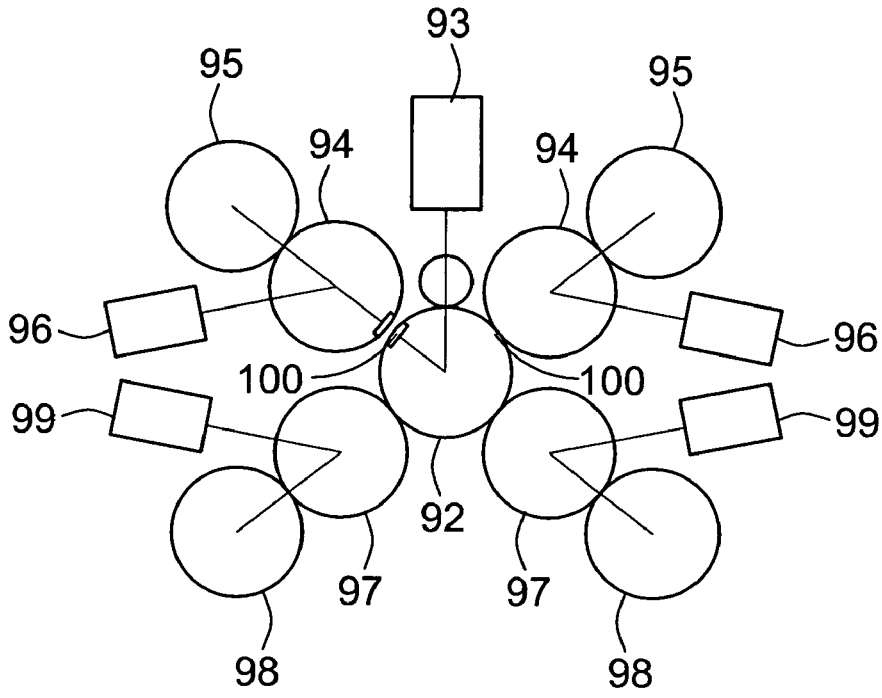
FIG. 21 is a schematic view of another embodiment of a printing unit including a drive arrangement according to the present invention that is based on the embodiment of FIG. 1.

FIG. 21 also illustrates a 9-cylinder printing unit. During printing operation, the printing mechanism including cylinders 94, 95 can be connected mechanically to the impression cylinder 92 via a clutch 100. As a result, the relatively high stress torque loading resulting from the three printing mechanisms 97, 98 that do not have a mechanical drive connection to the impression cylinder 92 is distributed to the two mechanically connected drive motors 93 and 96. The drive motor 93 can be designed with a less high motor output.

Figure 23:
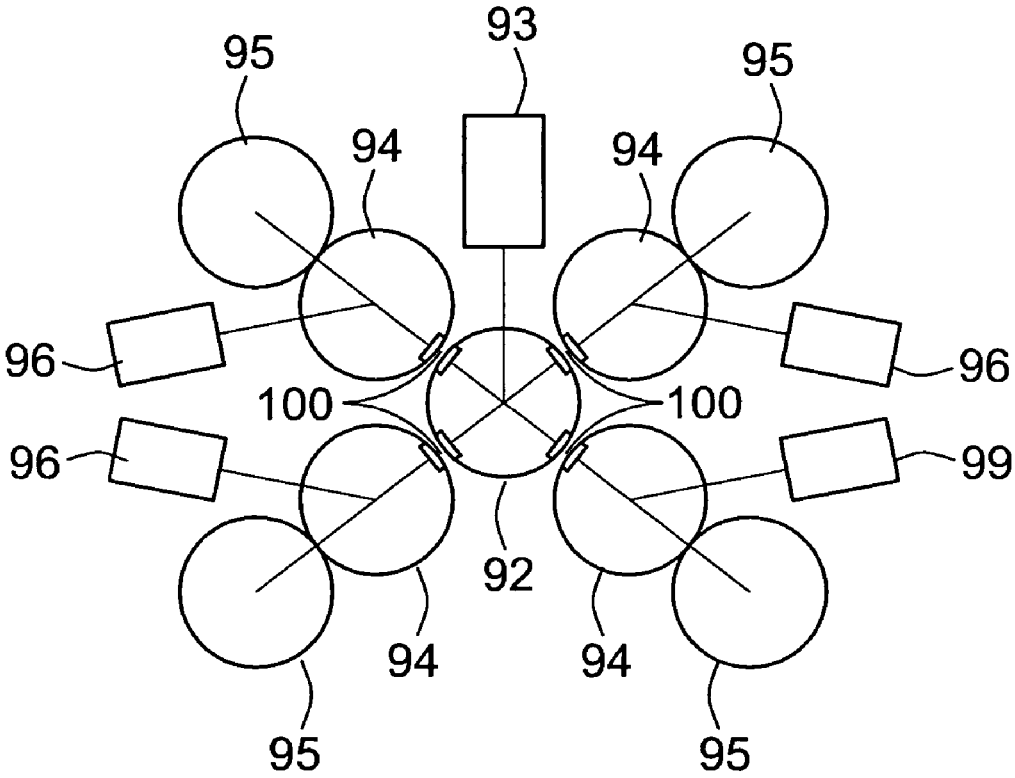
FIG. 23 is a schematic view of another embodiment of a printing unit including a drive arrangement according to the present invention that is based on the embodiment of FIG. 1.

Another 9-cylinder printing unit is illustrated in FIG. 23. In the FIG. 23 embodiment all the printing mechanisms 94, 95 in each case can be coupled to the impression cylinder 92 via a clutch 100 so that none of the drive motors 93 and 96 is loaded by additional stress torques.

Figure 22:
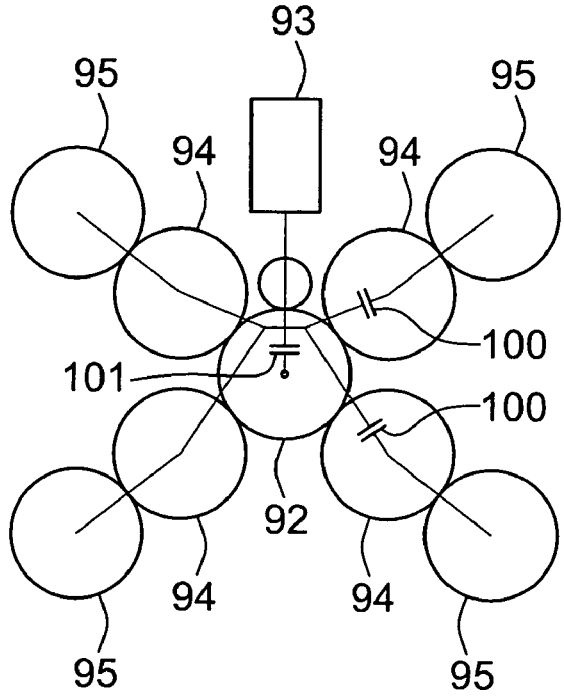
FIG. 22 is a schematic view of another embodiment of a printing unit including a drive arrangement according to the present invention.

A clutch 101 is illustrated in FIG. 22 that allows the impression cylinder 92 to be isolated from the associated printing mechanisms 94, 95 during set-up operations. During set-up operations, the printing mechanisms 94, 95 can be moved by the drive motor 93 without the impression cylinder 92 being rotated. This is advantageous if paper has been wrapped around the impression cylinder 92 and the associated printing mechanisms 94, 95 have to be rotated for set-up functions. Further clutches 100 are illustrated, so that the associated printing mechanisms 94, 95 can be uncoupled if, for example, they are not needed during the printing process.

What is claimed is:

1. A web-fed rotary printing unit comprising:

a plurality of printing mechanisms, each printing mechanism including an impression cylinder and further cylinders comprising a form cylinder and a transfer cylinder;

a first drive motor associated with the impression cylinder of a first printing mechanism, the first drive motor having a first drive connection to the further cylinders of the first printing mechanism through the impression cylinder of the first printing mechanism;

a second drive motor for driving the further cylinders of the first printing mechanism which is connected to the first drive motor by the first mechanical drive connection;

a drive coupling in the first mechanical drive connection that is in an engaged position during printing operation in order to prevent stressing the first and second drive motors with a a restraining moment between the impression cylinder and the further cylinders of the first printing mechanism and that is in a disengaged position during setting up operation such that the further cylinders of the first printing mechanism are independently drivable by the second drive motor;

a second printing mechanism including the impression cylinder of the first printing mechanism and further cylinders comprising a form cylinder and a transfer cylinder; and a third drive motor for driving the further cylinders of the second printing mechanism, the third drive motor not being connected to the first mechanical drive connection.

2. A web-fed rotary printing unit according to claim 1, wherein the first drive connection includes connecting gears that are interengaged and fitted to shafts of the further cylinders.

3. A web-fed rotary printing unit according to claim 1, wherein a gear train is arranged between the first drive motor and the impression cylinder of the first printing mechanism.

4. A web-fed rotary printing unit according to claim 1, wherein the impression cylinder of printing mechanism can be uncoupled from the first drive motor without the first drive motor being uncoupled from the further cylinders of the first printing mechanism.

5. A web-fed rotary printing unit according to claim 1, wherein the drive coupling comprises an isolating clutch that is provided between the impression cylinder of the first printing mechanism and at least one of the further cylinders of the first printing mechanism.

6. A web-fed rotary printing unit according to claim 5, wherein the isolating clinch is a register-maintaining clutch having at least one defined coupling position.

7. A web-fed rotary printing unit according to claim 5, wherein the isolating clutch is couplable in any desired position.

8. A web-fed rotary printing unit according to claim 1, wherein the drive coupling comprises an isolating clutch that is provided between the impression cylinder of the at least one printing mechanism and the associated transfer cylinders of the at least one printing mechanism.

9. A web-fed rotary printing unit according to claim 1, wherein the drive coupling comprises an isolating clutch that is provided between the transfer cylinder and the associated form cylinder of the at least one printing mechanism.

10. A web-fed rotary printing unit according to claim 1, wherein the second drive motor drives one of the further cylinders either directly or via a gear train.

11. A web-fed rotary printing unit according to claim 1, wherein a further isolating clutch is provided between the second drive motor and the farther cylinders of the first printing mechanism.

12. A web-fed rotary printing unit according to claim 11, wherein the second drive motor is connected to the form cylinder of the first printing mechanism and the further isolating clutch is provided between the second drive motor and the form cylinder.

13. A web-fed rotary printing unit according to claim 1, wherein in order to set the circumferential register of the printing unit, a cylinder having a fixed obliquely toothed gear is displaceable axially in order to force rotation of the form cylinder of the first printing mechanism.

14. A web-fed rotary printing unit according to claim 1, wherein in order to set the circumferential register of the printing unit, an obliquely toothed gear is displaceable axially on a cylinder in order to force rotation of the form cylinder of the first printing mechanism.

15. A web-fed rotary printing unit according to claim 1, wherein the form cylinder of the printing mechanism is rotatable by the first drive motor without rotating the impression cylinder.

16. A web-fed rotary printing unit according to claim 1, wherein in order to set the circumferential register of the printing unit, the form cylinder and the coupled impression cylinder of the first printing mechanism is rotatable by the first drive motor.

* * * * *